US012693017B2

(12) United States Patent
Singh et al.

(10) Patent No.: US 12,693,017 B2
(45) Date of Patent: Jul. 28, 2026

(54) COMBUSTOR DILUTION WITH VORTEX GENERATING TURBULATORS

(71) Applicant: General Electric Company, Schenectady, NY (US)

(72) Inventors: Saket Singh, Bengaluru (IN); Pradeep Naik, Bengaluru (IN); Daniel J. Kirtley, Blue Ash, OH (US); Rimple Rangrej, Bengaluru (IN); Ranganatha Narasimha Chiranthan, Bengaluru (IN)

(73) Assignee: GENERAL ELECTRIC COMPANY, Evendale, OH (US)

( * ) Notice: Subject to any disclaimer, the term of this patent is extended or adjusted under 35 U.S.C. 154(b) by 0 days.

(21) Appl. No.: 18/354,167

(22) Filed: Jul. 18, 2023

(65) Prior Publication Data

US 2023/0358403 A1 Nov. 9, 2023

Related U.S. Application Data

(62) Division of application No. 17/320,756, filed on May 14, 2021, now abandoned.

(51) Int. Cl.

| | |
|---|---|
| ***F23R 3/26*** | (2006.01) |
| ***F23R 3/00*** | (2006.01) |
| ***F23R 3/12*** | (2006.01) |

(52) U.S. Cl.

CPC ..... *F23R 3/26* (2013.01); *F23R 3/002* (2013.01); *F23R 3/12* (2013.01); *F23R 2900/03045* (2013.01)

(58) Field of Classification Search

CPC .... F02C 3/04; F05D 2220/03; F05D 2240/35; F23R 3/002; F23R 3/12; F23R 3/26; F23R 2900/03045

See application file for complete search history.

(56) References Cited

U.S. PATENT DOCUMENTS

| | | | | |
|---|---|---|---|---|
| 3,872,664 A | | 3/1975 | Lohmann et al. | |
| 4,315,405 A | | 2/1982 | Pidcock et al. | |
| 4,887,432 A | * | 12/1989 | Mumford | F23R 3/045 60/759 |
| 5,501,071 A | | 3/1996 | Ansart et al. | |

(Continued)

FOREIGN PATENT DOCUMENTS

| | | | |
|---|---|---|---|
| CN | 103216848 | A | 7/2013 |
| CN | 104566475 | A | 4/2015 |

(Continued)

*Primary Examiner* — Devon C Kramer
*Assistant Examiner* — Henry Ng
(74) *Attorney, Agent, or Firm* — Venable LLP; Michele V. Frank

(57) ABSTRACT

A combustor for a gas turbine engine. The combustor has a combustor liner that includes a vortex turbulence generator. The vortex turbulence generator has a flow passage extending therethrough, the flow passage being defined by a wall about a periphery of the flow passage, and a plurality of vortex generating turbulators disposed on the wall, each of the plurality of vortex generating turbulators a projection portion extending from a surface of the wall into the flow passage and generating a vortex turbulent flow of an oxidizer passing through the flow passage from a cold surface side of the combustor liner to a hot surface side of the combustor liner.

15 Claims, 7 Drawing Sheets

(56) References Cited

U.S. PATENT DOCUMENTS

| | | | | |
|---|---|---|---|---|
| 7,395,669 | B2 | 7/2008 | Sherwood | |
| 8,281,600 | B2 | 10/2012 | Chen et al. | |
| 9,534,790 | B2 * | 1/2017 | Cai | F23R 3/346 |
| 10,196,902 | B2 | 2/2019 | Moore et al. | |
| 10,533,749 | B2 | 1/2020 | Sreekanth et al. | |
| 11,255,543 | B2 | 2/2022 | Amble et al. | |
| 2012/0036859 | A1 | 2/2012 | Johnson et al. | |
| 2012/0297778 | A1 | 11/2012 | Rudrapatna et al. | |
| 2016/0186998 | A1 | 6/2016 | Kostka, Jr. et al. | |
| 2016/0201908 | A1 | 7/2016 | Drake et al. | |
| 2016/0209035 | A1 | 7/2016 | Cramer | |
| 2016/0327272 | A1 | 11/2016 | Sandoval et al. | |
| 2017/0059162 | A1 | 3/2017 | Papple et al. | |
| 2017/0096900 | A1 * | 4/2017 | Bunker | F01D 9/04 |
| 2017/0219212 | A1 * | 8/2017 | Laster | F02C 3/30 |
| 2018/0266324 | A1 * | 9/2018 | Lao | F02C 7/24 |
| 2019/0301738 | A1 | 10/2019 | North et al. | |
| 2020/0132304 | A1 | 4/2020 | Dudebout et al. | |
| 2020/0149406 | A1 * | 5/2020 | Nam | F02C 7/12 |
| 2020/0158342 | A1 | 5/2020 | Boardman et al. | |
| 2020/0340673 | A1 * | 10/2020 | Verduzco | F23R 3/045 |

FOREIGN PATENT DOCUMENTS

| | | | |
|---|---|---|---|
| CN | 205079262 | U | 3/2016 |
| CN | 110793061 | A | 2/2020 |
| EP | 0905353 | B1 | 1/2003 |
| EP | 1508746 | B1 | 2/2012 |
| EP | 2384392 | B1 | 5/2017 |
| EP | 3018416 | B1 | 9/2019 |
| GB | 2356042 | A | 5/2001 |
| WO | 2004035992 | A1 | 4/2004 |
| WO | 2013165506 | A3 | 11/2013 |

* cited by examiner

COMBUSTOR DILUTION WITH VORTEX GENERATING TURBULATORS

CROSS-REFERENCE TO RELATED APPLICATIONS

This application is a divisional of U.S. patent application Ser. No. 17/320,756 filed on May 14, 2021, the contents of which are hereby incorporated by reference in their entirety.

TECHNICAL FIELD

The present disclosure relates to a dilution of combustion gases in a combustion chamber of a gas turbine engine. More particularly, the disclosure relates to a dilution vortex turbulence generator in a combustion chamber liner for generating a turbulent flow of dilution gas into the combustion chamber so as to increase turbulence and mixing with combustion gases.

BACKGROUND

In conventional gas turbine engines, it has been known to provide a flow of dilution air into a combustion chamber downstream of a primary combustion zone. Conventionally, an annular combustor may include both inner and outer liners forming a combustion chamber between them. The inner and outer combustion liners may include dilution holes through the liners that provide a flow of air from a passage surrounding the annular combustor into the combustion chamber. Some applications have been known to use circular holes, while other applications have been known to use different shapes of dilution holes for providing dilution air flow to the combustion chamber. Other applications have been known to use axially-aligned angled dilution holes through the liner. The angled dilution holes are generally aligned in a flow direction from upstream to downstream so as to provide a flow of dilution air to the combustion chamber. Some other applications may include a flared outlet on the inner portion of the hole to provide a larger spread of the dilution air near the hole outlet. Still other applications may use a raised inlet or standoff around the dilution hole. The standoff is generally aligned normal to the surface of the liner so as to provide a flow of dilution air straight-in to the combustion chamber. The flow of air through the dilution holes in the conventional combustor is generally normal to the surface of the liner, and generally stays close to the surface of the liner. The conventional dilution air flow close to the surface of the liner helps to cool the liner.

BRIEF SUMMARY

To address problems in the conventional art, the present inventors have devised techniques for inducing turbulence in the airflow passing through the dilution hole. According to one aspect, the present disclosure relates to a combustor for a gas turbine engine. The combustor has a combustor liner having a cold surface side and a hot surface side, a combustion chamber arranged on the hot surface side of the combustor liner, and a vortex turbulence generator arranged on the combustor liner. The vortex turbulence generator includes a turbulence generator flow passage extending through the combustor liner from the cold surface side of the combustor liner to the hot surface side of the combustor liner. The turbulence generator flow passage is defined by a turbulence generator wall about a periphery of the turbulence generator flow passage, and a plurality of vortex generating turbulators are disposed on the turbulence generator wall. Each of the plurality of vortex generating turbulators include a projection portion extending from a surface of the turbulence generator wall into the turbulence generator flow passage and generate a vortex turbulent flow of an oxidizer passing through the turbulence generator flow passage from the cold surface side of the combustor liner to the hot surface side of the combustor liner.

Another aspect of the present disclosure is directed to a dilution vortex turbulence generator for a combustor of a gas turbine engine. The dilution vortex turbulence generator may be in the form of, for example, an insert to be installed in the combustor liner. Thus, the dilution vortex turbulence generator may include a base body having a cold surface side and a hot surface side, a turbulence generator flow passage extending through the base body from the cold surface side to the hot surface side, where the turbulence generator flow passage is defined by a turbulence generator wall about a periphery of the turbulence generator flow passage. A plurality of vortex generating turbulators are disposed on the turbulence generator wall, each of the plurality of vortex generating turbulators including a projection portion extending from a surface of the turbulence generator wall into the turbulence generator flow passage and generating a vortex turbulent flow of an oxidizer passing through the turbulence generator flow passage from the cold surface side of the base body to the hot surface side of the base body.

Additional features, advantages, and embodiments of the present disclosure are set forth or apparent from consideration of the following detailed description, drawings and claims. Moreover, it is to be understood that both the foregoing summary and the following detailed description are exemplary and intended to provide further explanation without limiting the scope of the disclosure as claimed.

BRIEF DESCRIPTION OF THE DRAWINGS

The foregoing and other features and advantages will be apparent from the following, more particular, description of various exemplary embodiments, as illustrated in the accompanying drawings, wherein like reference numbers generally indicate identical, functionally similar, and/or structurally similar elements.

DETAILED DESCRIPTION

Figure 1:
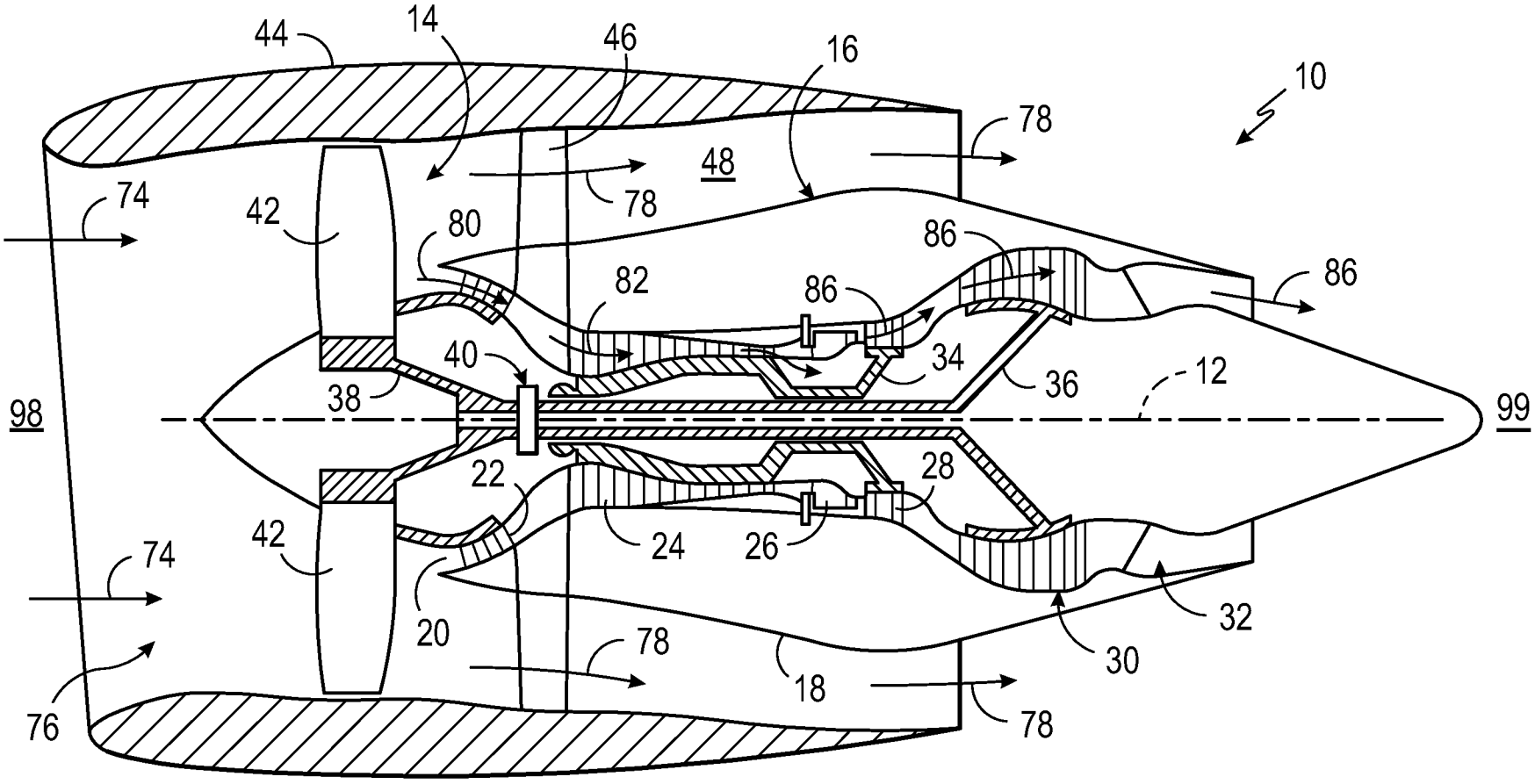
FIG. 1 is a schematic partially cross-sectioned side view of an exemplary high by-pass turbofan jet engine, according to an embodiment of the present disclosure.

Various embodiments are discussed in detail below. While specific embodiments are discussed, this is done for illustration purposes only. A person skilled in the relevant art will recognize that other components and configurations may be used without departing from the spirit and scope of the present disclosure.

As used herein, the terms "first", "second", and "third" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

Some conventional dilution holes are simple holes through the liner that provide air flow normal to the surface of the liner. One purpose of the dilution air flow is to cool the combustion gases before they enter a turbine section. Another purpose of the dilution air flow is to provide surface cooling of the liner. Conventional dilution holes do not, however, provide a turbulent flow from the dilution hole into the combustion chamber, which results in poor mixing with the combustion gases. Additionally, the non-turbulent air exiting the conventional dilution hole stagnates at the trailing edge of the dilution hole, which increases the temperature of the combustor liner in the stagnation zone. Thus, there exists a need to provide better mixing and to reduce the stagnation zone caused by the conventional dilution hole. The present inventors, therefore, have found that a need exists to induce turbulence of the dilution airflow through the dilution hole so as to provide a better mixture of the dilution air and the combustion gases, and to reduce the stagnation zone.

The present disclosure generally relates to providing dilution air flow into a dilution zone of a combustor. As dilution air flow enters the combustion chamber via the dilution holes, it is mixed at the liner surface with hot combustion gases flowing through the combustion chamber. One purpose of the dilution air flow is to cool the combustion gases before they enter a turbine section. Another purpose of the dilution air flow is to provide surface cooling of the liner. However, when the air flow is normal to the surface and generally not turbulent, the air flow stays close to the surface of the liner. As a result, high temperature gases accumulate at the downstream edge and surface of the hole, thereby reducing the reliability of the liner. Additionally, if the dilution air flow stays close to the liner surface, it does not provide for efficient mixing and cooling of the combustion gases away from the liner surface. Thus, what is needed is a way to reduce NOx emissions in the dilution zone By providing better mixing of the dilution air flow with the combustion gases NOx emissions in the dilution zone can be reduced and better reliability of the combustor liner about the dilution holes can be achieved.

According the present disclosure, a vortex turbulence generator is formed at a dilution hole in a dilution zone of the combustor. Air flowing in an outer chamber on a cold side of a combustor liner flows through the vortex turbulence generator into the combustion chamber to provide mixing with combustion gases and to provide cooling of the liner surface. The vortex turbulence generator according to the present disclosure includes a flow passage in the form of a hole in the liner, where a wall of the hole is lined with turbulators. The turbulators are projections extending from the wall into the hole and are shaped so as to generate a vortex in the air flow passing over the turbulators. The turbulators may in the form of a conical shaped protrusion extending from the wall, with the base of the conical shape attached to the wall. As air flows over the surface of the turbulator, a vortex is generated in the air flow. The turbulators may also be in an arrangement on the wall that also generates a vortex air flow about the hole. For example, the turbulators may be placed along the wall in a helical fashion such that, as the air flows through the hole, a vortex flow about the circumference of the hole may also be generated. In some embodiments, a center portion of the hole may generally be open to allow some of the air to flow freely through the open portion without flowing over the turbulators. This has the effect of forming a main jet of relatively non-turbulent air flow through the middle of the hole, surrounded by turbulent vortex flow generated by the turbulators. In other embodiments, a main jet structure may be included in the center of the hole to separate the air flow in the hole into a generally non-turbulent jet air flow through the jet, and a vortex turbulent flow surrounding the jet in the turbulator portion of the hole. The flow from the jet then mixes with the turbulent airflow in the combustion chamber.

Due to the turbulent air flow surrounding the main jet air flow, a deeper penetration of the dilution air into the combustion chamber can be achieved. In addition, the turbulent air flow as it exits the hole provides for dilution air being present in the wake of the overall flow on the downstream side of the hole. This provides for cooler temperatures on the liner surface at the downstream portion of the hole, thereby increasing the reliability of the liner.

Referring now to the drawings, FIG. 1 is a schematic partially cross-sectioned side view of an exemplary high by-pass turbofan jet engine 10, herein referred to as "engine 10," as may incorporate various embodiments of the present disclosure. Although further described below with reference to a turbofan engine, the present disclosure is also applicable to turbomachinery in general, including turbojet, turboprop, and turboshaft gas turbine engines, including marine and industrial turbine engines and auxiliary power units. As shown in FIG. 1, engine 10 has a longitudinal or axial centerline axis 12 that extends there through from an upstream end 98 to a downstream end 99 for reference purposes. In general, engine 10 may include a fan assembly 14 and a core engine 16 disposed downstream from the fan assembly 14.

The core engine 16 may generally include a substantially tubular outer casing 18 that defines an annular inlet 20. The outer casing 18 encases or at least partially forms, in serial flow relationship, a compressor section having a booster or low pressure (LP) compressor 22, a high pressure (HP) compressor 24, a combustion section 26, a turbine section including a high pressure (HP) turbine 28, a low pressure (LP) turbine 30 and a jet exhaust nozzle section 32. A high pressure (HP) rotor shaft 34 drivingly connects the HP turbine 28 to the HP compressor 24. A low pressure (LP) rotor shaft 36 drivingly connects the LP turbine 30 to the LP compressor 22. The LP rotor shaft 36 may also be connected to a fan shaft 38 of the fan assembly 14. In particular embodiments, as shown in FIG. 1, the LP rotor shaft 36 may be connected to the fan shaft 38 by way of a reduction gear 40 such as in an indirect-drive or geared-drive configuration. In other embodiments, although not illustrated, the engine 10 may further include an intermediate pressure (IP) compressor and turbine rotatable with an intermediate pressure shaft.

As shown in FIG. 1, the fan assembly 14 includes a plurality of fan blades 42 that are coupled to and that extend radially outwardly from the fan shaft 38. An annular fan casing or nacelle 44 circumferentially surrounds the fan assembly 14 and/or at least a portion of the core engine 16. In one embodiment, the nacelle 44 may be supported relative to the core engine 16 by a plurality of circumferentially-spaced outlet guide vanes or struts 46. Moreover, at least a portion of the nacelle 44 may extend over an outer portion of the core engine 16 so as to define a bypass airflow passage 48 therebetween.

Figure 2:
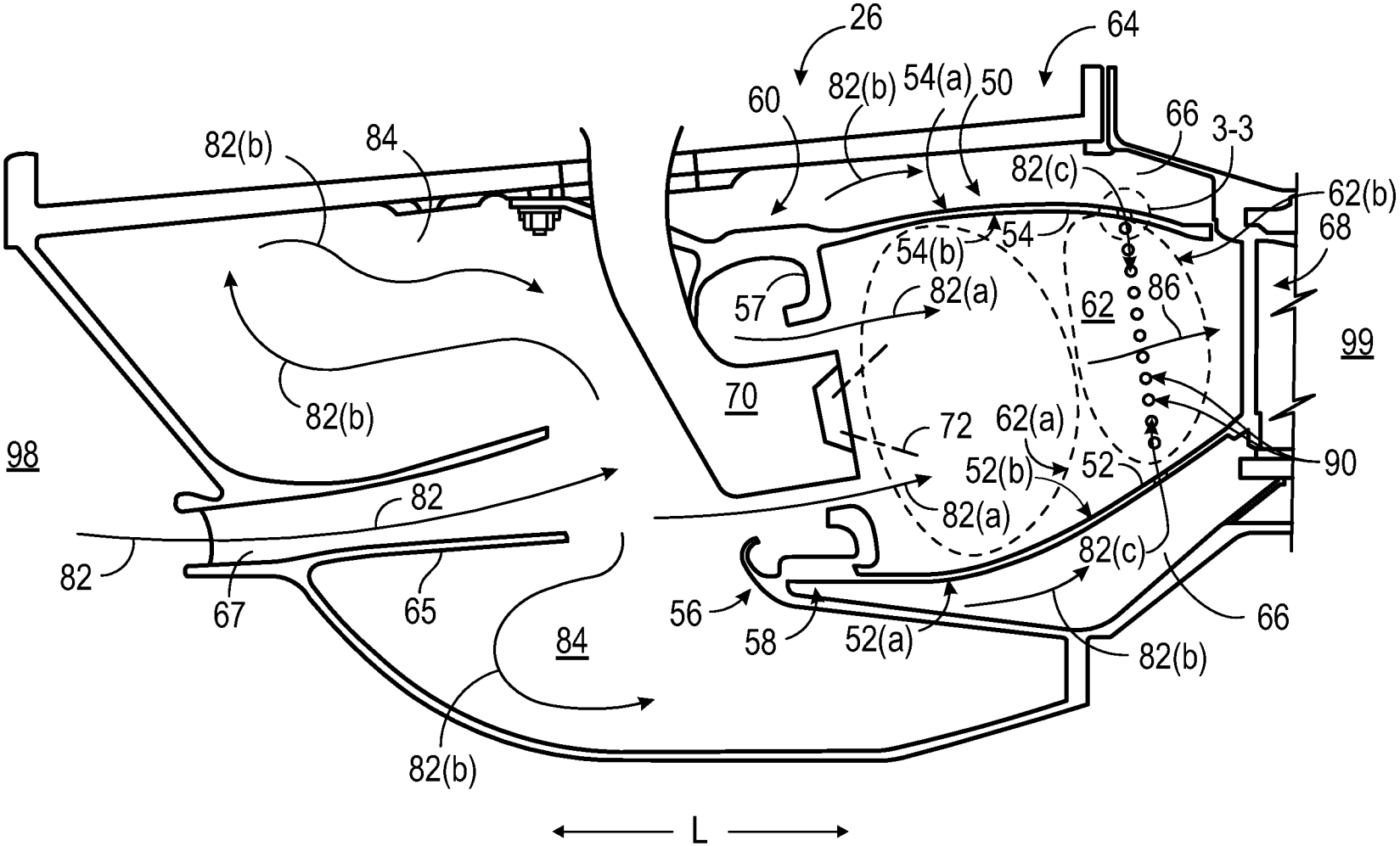
FIG. 2 is a cross sectional side view of an exemplary combustion section, according to an embodiment of the present disclosure.

FIG. 2 is a cross sectional side view of an exemplary combustion section 26 of the core engine 16 as shown in FIG. 1. As shown in FIG. 2, the combustion section 26 may generally include an annular type combustor assembly 50 having an annular inner liner 52, an annular outer liner 54, and a bulkhead wall 56 together defining a combustion chamber 62. The combustion chamber 62 may more specifically define a region defining a primary combustion zone 62(*a*) at which initial chemical reaction of a fuel-oxidizer mixture 72 and/or recirculation of combustion gases 86 may occur before flowing further downstream to dilution zone 62(*b*), where mixture and/or recirculation of combustion products and air may occur before flowing to the HP and LP turbines 28, 30. The bulkhead wall 56 and dome assembly 57 each extend radially between upstream ends 58, 60 of the radially spaced inner liner 52 and the outer liner 54, respectively. The dome assembly 57 is disposed downstream of the bulkhead wall 56, adjacent to the generally annular combustion chamber 62 defined between the dome assembly 57, the inner liner 52, and the outer liner 54. In particular embodiments, the inner liner 52 and/or the outer liner 54 may be at least partially or entirely formed from metal alloys or ceramic matrix composite (CMC) materials.

As shown in FIG. 2, the inner liner 52 and the outer liner 54 may be encased within a diffuser or outer casing 64. An outer flow passage 66 may be defined around the inner liner 52 and/or the outer liner 54. The inner liner 52 and the outer liner 54 may extend from the bulkhead wall 56 towards a turbine nozzle or inlet 68 to the HP turbine 28 (FIG. 1), thus at least partially defining a hot gas path between the combustor assembly 50 and the HP turbine 28. An outer surface of the inner liner 52 adjacent to the outer flow passage 66 may be referred to as a cold surface side 52(*a*) and an outer surface of the outer liner 54 adjacent to the outer flow passage 66 may be referred to as a cold surface side 54(*a*). An inner surface of the inner liner 52 adjacent to the hot gas path may be referred to as a hot surface side 52(*b*) and an inner surface of the outer liner 54 adjacent to the hot gas path may be referred to as a hot surface side 54(*b*).

As further seen in FIG. 2, each of inner liner 52 and outer liner 54 of the combustor assembly 50 may include a plurality of dilution vortex turbulence generators 90. As will be described in more detail below, dilution vortex turbulence generators 90 provide a flow of compressed air 82(*c*) therethrough and into the combustion chamber 62. The flow of compressed air 82(*c*) can thus be utilized to both cool a portion of the inner liner 52 and the outer liner 54, and also to provide cooling to the combustion gases 86 downstream of the primary combustion zone 62(*a*) so as to cool the flow of combustion gases 86 entering the turbine section.

During operation of the engine 10, as shown in FIGS. 1 and 2 collectively, a volume of air as indicated schematically by arrows 74 enters the engine 10 from upstream end 98 through an associated inlet 76 of the nacelle 44 and/or fan assembly 14. As the air 74 passes across the fan blades 42, a portion of the air as indicated schematically by arrows 78 is directed or routed into the bypass airflow passage 48, while another portion of the air as indicated schematically by arrow 80 is directed or routed into the LP compressor 22. Air 80 is progressively compressed as it flows through the LP and HP compressors 22, 24 towards the combustion section 26. As shown in FIG. 2, the now compressed air as indicated schematically by arrows 82 flows across a compressor exit guide vane (CEGV) 67 and through a pre-diffuser 65 into a diffuser cavity 84 of the combustion section 26.

The compressed air 82 pressurizes the diffuser cavity 84. A first portion of the compressed air 82, as indicated schematically by arrows 82(*a*) flows from the diffuser cavity 84 into the combustion chamber 62 where it is mixed with fuel ejected from fuel-nozzle 70 to form a fuel/air mixture 72 that is burned, thus generating combustion gases 86, as indicated schematically by arrows 86, within a primary combustion zone 62(*a*) of the combustor assembly 50. Typically, the LP and HP compressors 22, 24 provide more compressed air to the diffuser cavity 84 than is needed for combustion. Therefore, a second portion of the compressed air 82 as indicated schematically by arrows 82(*b*) may be used for various purposes other than combustion. For example, as shown in FIG. 2, compressed air 82(*b*) may be routed into the outer flow passage 66 to provide cooling to the inner liner 52 and the outer liner 54. A portion of the compressed air 82(*b*) may be routed through dilution vortex turbulence generators 90 (schematically shown as compressed air 82(*c*)) and into the dilution zone 62(*b*) of combustion chamber 62 to provide cooling to the inner liner 52 and outer liner 54. Compressed air 82(*c*) may also provide cooling of the combustion gases 86 in dilution zone 62(*b*), and may also provide turbulence to the flow of combustion gases 86 so as to provide better mixing of the dilution oxidizer gas (compressed air 82(*c*)) with the combustion gases 86. In addition, or in the alternative, at least a portion of compressed air 82(*b*) may be routed out of the diffuser cavity 84. For example, a portion of compressed air 82(*b*) may be directed through various flow passages to provide cooling air to at least one of the HP turbine 28 or the LP turbine 30.

Referring back to FIGS. 1 and 2 collectively, the combustion gases 86 generated in the combustion chamber 62 flow from the combustor assembly 50 into the HP turbine 28, thus causing the HP rotor shaft 34 to rotate, thereby supporting operation of the HP compressor 24. As shown in FIG. 1, the combustion gases 86 are then routed through the LP turbine 30, thus causing the LP rotor shaft 36 to rotate, thereby supporting operation of the LP compressor 22 and/or rotation of the fan shaft 38. The combustion gases 86 are then exhausted through the jet exhaust nozzle section 32 of the core engine 16 to provide propulsive at downstream end 99.

Figure 3:
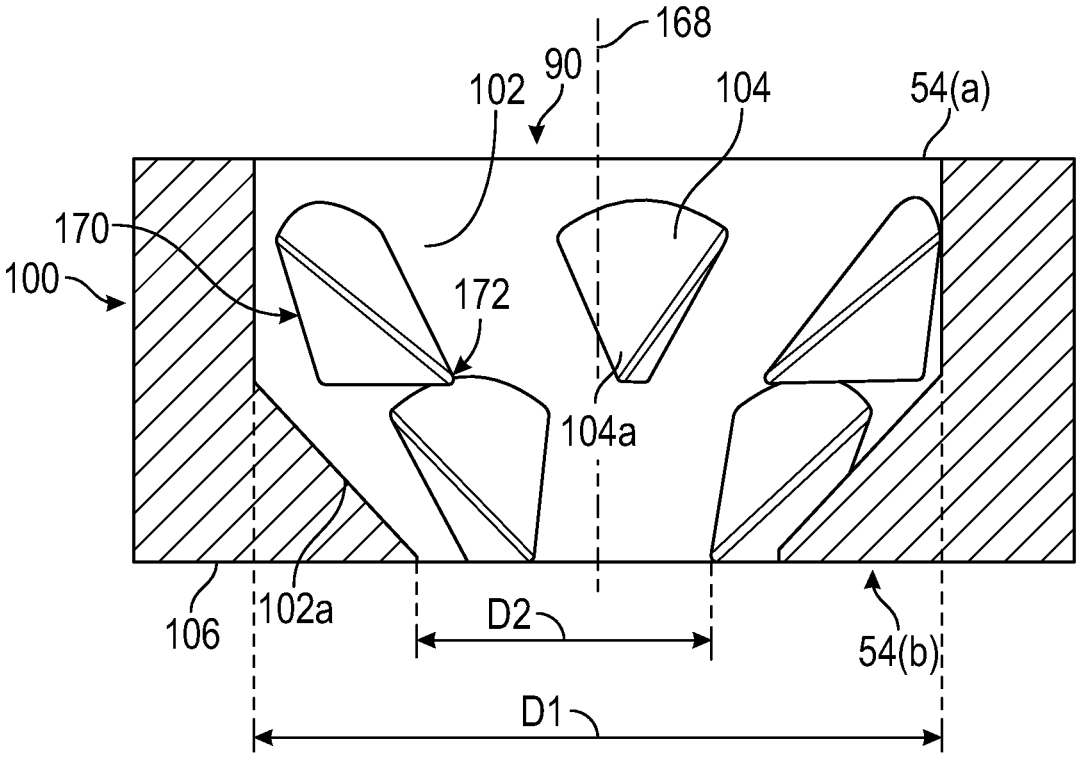
FIG. 3 is a cross sectional view a vortex turbulence generator, according to an embodiment of the present disclosure.
Figure 4:
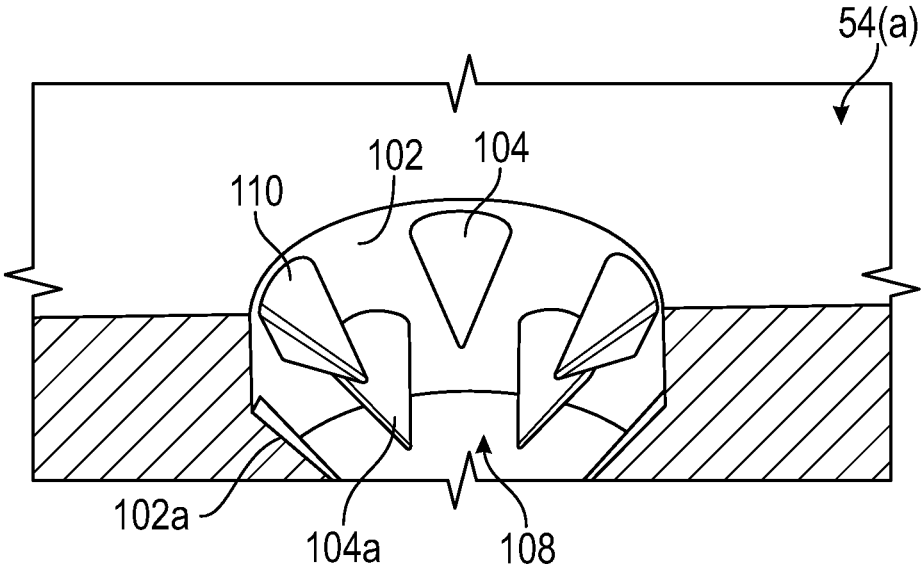
FIG. 4 is a perspective sectional view of a vortex turbulence generator, according to an embodiment of the present disclosure.

FIG. 3 is an enlarged view of a section of the outer liner 54 seen in detail 3-3 of FIG. 2. In FIG. 3, a cross section of a dilution vortex turbulence generator according to one embodiment of the present disclosure is depicted. The dilution vortex turbulence generator of FIG. 3 may be formed as an insert to be installed in the inner liner 52 or the outer liner 54. Alternatively, the dilution vortex turbulence generator may be formed integral with the inner liner 52 and the outer liner 54. FIG. 3 depicts an example of the dilution vortex turbulence generator as an insert, while FIG. 4 depicts a dilution vortex turbulence generator that may be integral with the inner liner 52 or the outer liner 54. In FIG. 3, a dilution vortex turbulence generator element 100 is seen to include a base body 106. The base body 106 may be generally cylindrical in shape so as to fit within a corresponding hole of the inner liner 52, or the outer liner 54. The base body 106 includes a cold surface side 54(*a*) and a hot surface side 54(*b*). The cold surface side 54(*a*), when installed in the outer liner 54, is adjacent to the outer flow passage 66, while the hot surface side 54(*b*) is adjacent the combustion chamber 62. Formed through the base body 106 is an oxidizer flow passage 108 that allows a flow of compressed air 82(*c*) of the oxidizer to pass from the outer flow passage 66 into the combustion chamber 62. The oxidizer flow passage 108 includes a wall 102 that extends between the cold surface side 54(*a*) to the hot surface side 54(*b*). The wall 102 may be cylindrical the entire length of the oxidizer flow passage 108 from the cold surface side 54(*a*) of the base body 106 to the hot surface side 54(*b*) of the base body 106. Alternatively, a portion of the wall 102 may be cylindrical along a portion of an axial length of the oxidizer flow passage 108, while another portion (102*a*) of the wall 102 may be conical shaped. In another embodiment, the entire oxidizer flow passage 108 may be conical shaped. In either case, a major diameter D1 of the conical shaped surface 102*a* of the oxidizer flow passage 108 is arranged toward the cold surface side 54(*a*) of the base body 106, while a minor diameter D2 of the conical shaped surface 102*a* is arranged toward the hot surface side 54(*b*) of the base body 106.

Referring again to FIGS. 3 and 4, a plurality of vortex generating turbulators 104 are seen attached to the wall 102 and include a projection portion 104*a* extending from the wall 102 into an open portion of the flow passage 108. Each of the vortex generating turbulators are formed with an aerodynamic shape so that, as a flow of oxidizer (air) traverses across the turbulator, a vortex is generated in the flow by the turbulator. As seen in the figures, multiple rows of turbulators 104 may be provided about wall 102, where a first row of the turbulators 104 may be located closer to the cold surface side 54(*a*) and a second row of the turbulators 104 may be located closer to the hot surface side 54(*b*). Where multiple rows of turbulators 104 are provided, the turbulators 104 of one row may be rotationally staggered around the wall 102 about a centerline axis 168 of the flow passage 108, such as the turbulators 104 seen in two staggered rows of FIG. 4. Alternatively, a single row of turbulators 104 could be included instead, or more than two rows of turbulators 104 could be included. Further, an arrangement where the turbulators 104 extend along the wall in a helical pattern from the cold surface side 54(*a*) to the hot surface side 54(*b*) could be implemented. One objective of the turbulators 104 is to generate a vortex turbulent flow of oxidizer (air) flowing through the flow passage 108. More specifically, the turbulators 104 are arranged such that, at the hot surface side 54(*b*) where the oxidizer flow exits the flow passage 108 and enters the combustion chamber 62, a vortex or turbulent flow is generated at the exit.

In FIGS. 3 and 4, it can be seen that turbulators 104 are generally conical or pyramidal in shape, with a base portion 170 of the conical/pyramidal shaped turbulator being connected to the wall 102 and an apex portion 172 of the conical/pyramidal shaped turbulator extending into the open portion of the flow passage 108. One surface 110 of the conical/pyramidal shape is arranged for direct exposure to the air flow passing through the flow passage 108. For example, as seen in FIG. 3, the turbulator 104 may be a portion of a cone, with the outer conical surface 110 facing the cold surface side to receive the flow of incoming air. As the air flow passes over the conical shaped surface, a vortex is generated in the air flow by the turbulator 104. For the description herein, the surface 110 (and corresponding other surfaces described below) will generally be considered as a primary flow interface surface. That is, the surface 110 will be considered as a main aerodynamic surface of the turbulator that generally provides interaction with the incoming flow of oxidizer passing through the flow passage 108.

Figure 5A:
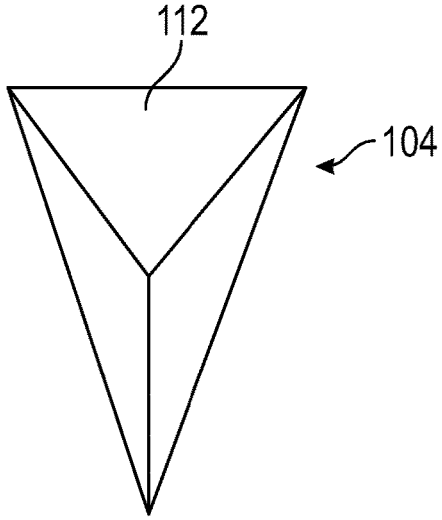
FIG. 5A depicts an example embodiment of a turbulator, according to an embodiment of the present disclosure.
Figure 5B:
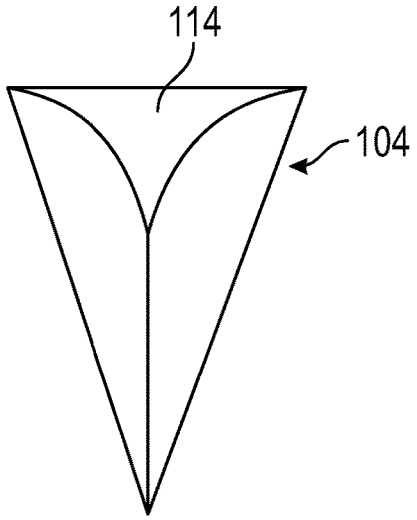
FIG. 5B depicts an example embodiment of a turbulator, according to an embodiment of the present disclosure.
Figure 5C:
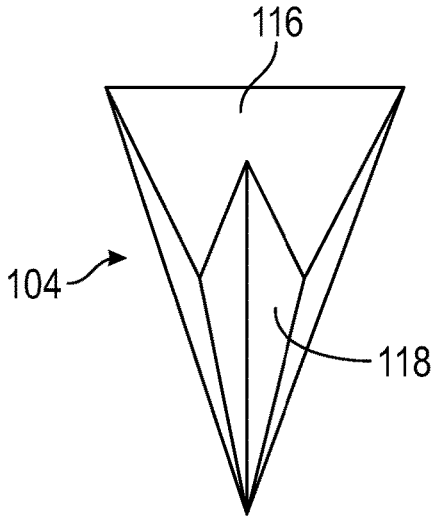
FIG. 5C depicts an example embodiment of a turbulator, according to an embodiment of the present disclosure.
Figure 5D:
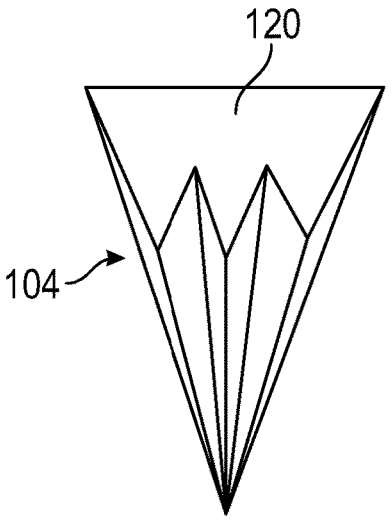
FIG. 5D depicts an example embodiment of a turbulator, according to an embodiment of the present disclosure.

Referring now to FIGS. 5A to 5D, depicted therein are some arrangements of turbulators 104 that may be implemented in the various embodiments of the present disclosure. Each of the turbulators 104 shown in FIGS. 5A to 5D may be arranged on the wall 102 similar to the turbulators shown in FIGS. 3 and 4. FIG. 5A depicts a generally pyramidal shaped turbulator 104 that includes a primary flow interface surface that is a generally triangular surface 112. In FIG. 5B, the turbulator 104 is again generally pyramidal shaped, and includes a primary flow interface surface 114 that is similar to the triangular surface 112 of FIG. 5A, but has rounded edges on the sides extending from the wall 102 into the open portion of the flow passage 108. In FIG. 5C, a surface 116 is similar to the triangular surface 112 of FIG. 5A, but has been divided into two triangles, with a cavity 118 being formed therebetween. FIG. 5D is similar to FIG. 5C, but includes three triangular sections of the surface 120.

Regardless of the shape of the turbulator 104 implemented, it can be understood that the attachment of the turbulators to the wall 102 may be adjusted based on the shape employed so as to provide a desired aerodynamic flow across the surface. For example, as seen in FIG. 4, the conical turbulator 104 may be installed on the wall such that the conical surface 110 is generally perpendicular to the incoming flow. However, the turbulator 104 may be rotated about the conical axis such that the conical surface 110 is at a desired angle relative to the incoming flow. Such an angle may provide for both generating a vortex turbulent flow off of the conical surface 110, as well as directing a portion of the incoming air flow to be deflected off the conical surface 110 in a tangential direction about the circumference of the wall 102. This can therefore provide an overall vortex flow within the flow passage 108.

In FIGS. 3 and 4, it can also be seen that a middle portion of the flow passage 108 may be open to allow a free flow of air to pass therethrough. That is, the length of the turbulators 104 may be such that they do not extend from the wall 102 across a central axis of the flow passage 108, thereby allowing an unobstructed hole between the tips of the turbulators 104, as seen in a plan view (not shown) from the cold surface side 54(*a*). Thus, this arrangement provides for a generally non-turbulent main jet of air flow to pass through the open portion, while the turbulators 104 generate a turbulent vortex flow surrounding the central main jet flow. The main jet flow would have a higher velocity than the slower turbulent flow when exiting the vortex turbulence generator at the hot surface side. The main jet flow can then penetrate deeper into the combustion chamber, while the surrounding turbulent flow can provide dilution air around the exit, particularly at the downstream wake portion of the flow (to be described in more detail below).

Figure 6:
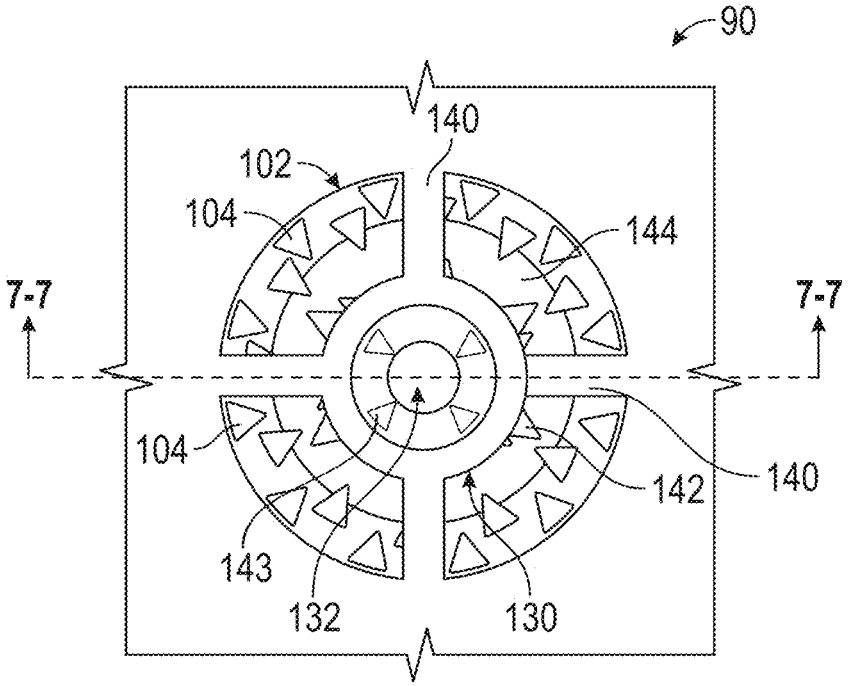
FIG. 6 is a plan view of another example vortex turbulence generator, according to an embodiment of the present disclosure.
Figure 7:
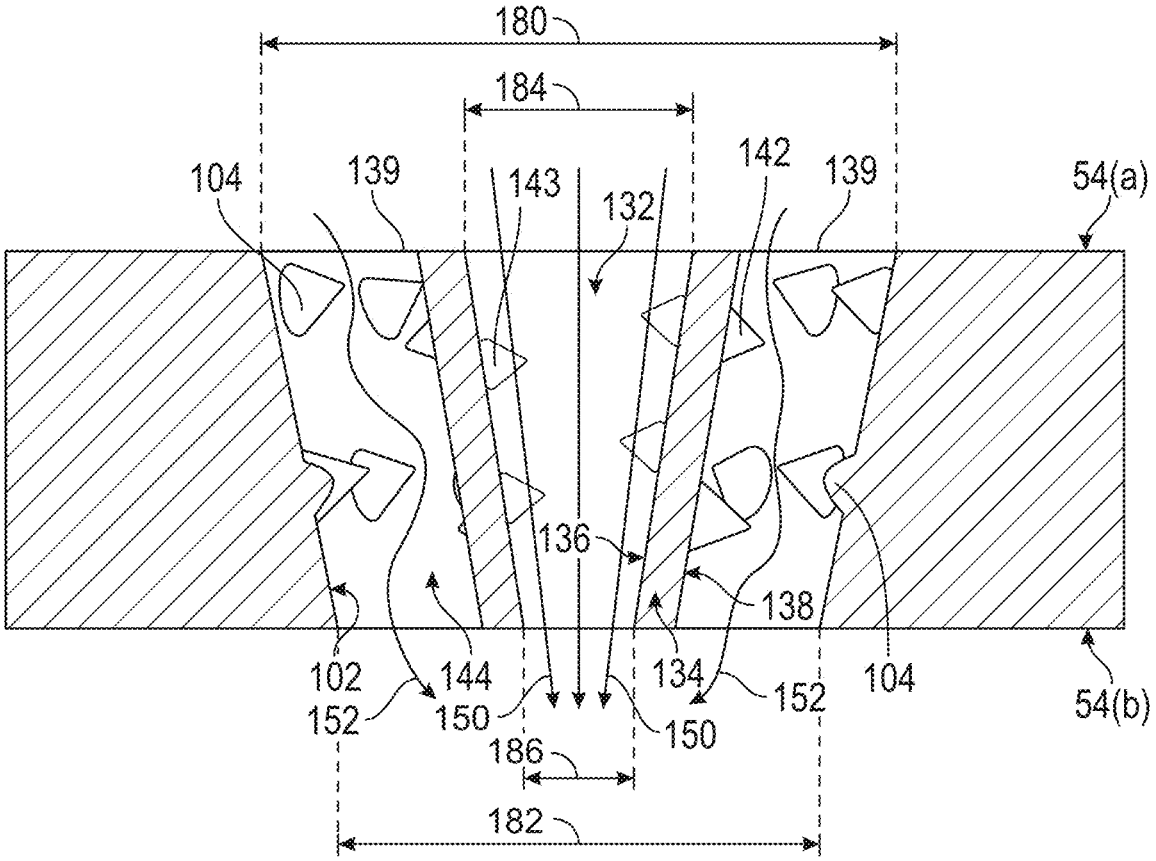
FIG. 7 is a cross-sectional view another vortex turbulence generator, according to an embodiment of the present disclosure.
Figure 8:
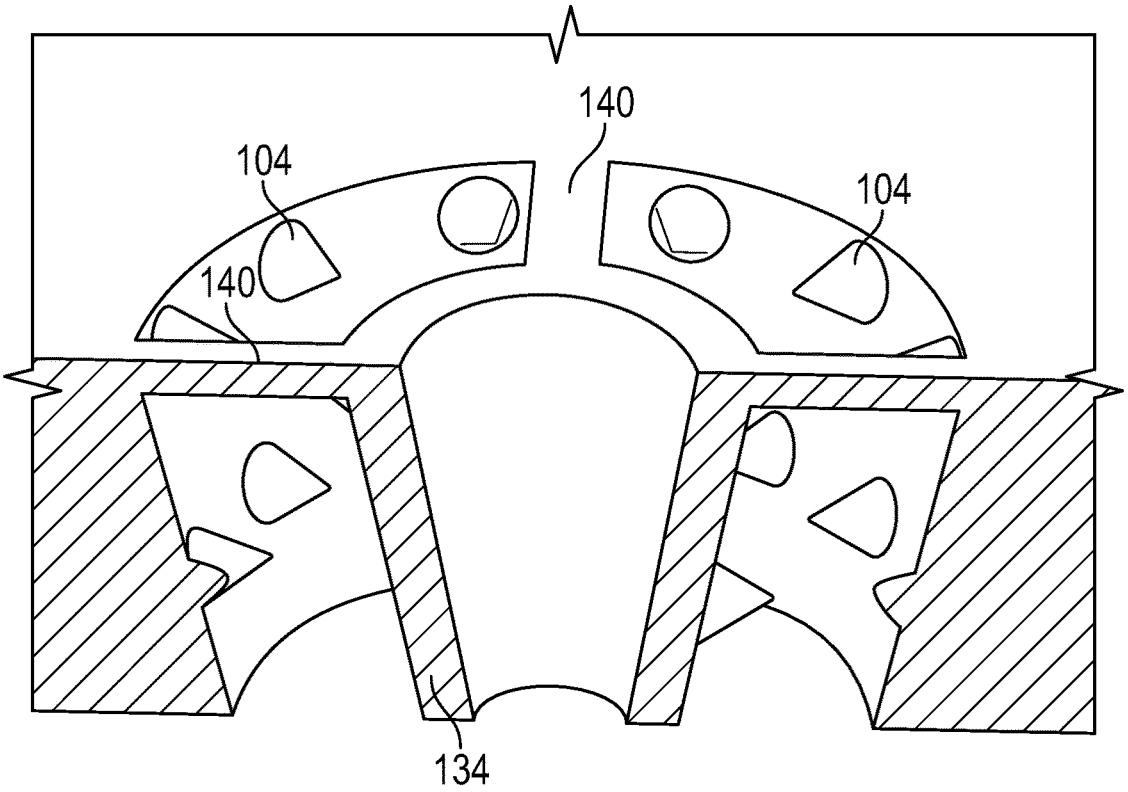
FIG. 8 is a perspective cross-sectional view another vortex turbulence generator, according to an embodiment of the present disclosure.

FIGS. 6 to 8 depict another embodiment of a dilution vortex turbulence generator according to the present disclosure. FIG. 6 is a plan view of a dilution vortex turbulence generator taken from the cold surface side 54(*a*) of the outer liner 54, for example. FIG. 7 is a cross-sectional view taken alone plane 7-7 shown in FIG. 6, and FIG. 8 is a perspective view of the cross-section taken alone plane 7-7. In FIGS. 6 to 8, the dilution vortex turbulence generator of the present embodiment includes a vortex turbulence generating portion 139 that is similar to that of FIGS. 3 and 4, but also includes dilution flow main jet 130 disposed therein. As seen in FIGS. 6 to 8, the present embodiment includes the wall 102 and turbulators 104 formed on the wall 102 similar to that shown in FIGS. 3 and 4, thereby forming the turbulence generating portion. As compared to FIGS. 3 and 4, however, it can be seen that the wall 102 in FIG. 7 is conical shaped extending from the cold surface side 54(*a*) to the hot surface side 54(*b*). A major diameter portion 180 of the conical wall is located at the cold surface side 54(*a*) and a minor diameter portion 182 of the conical wall is located at the hot surface side 54(*b*). Thus, the wall 102 forms a converging flow of the air passing therethrough. Attached to the wall 102 are turbulators 104, which may include any of the turbulator embodiments describe previously. In addition, similar to FIGS. 3 and 4, the present embodiment shown in FIGS. 6 to 8 includes two rows of turbulators about the wall 102. Thus, the forgoing wall and turbulators defines a turbulence generating portion of the present embodiment.

In the present embodiment, a dilution flow main jet 130 is included within the turbulence generating portion 139. The main jet 130 extends from the cold surface side 54(*a*) of the liner to the hot surface side 54(*b*) of the liner. The main jet 130 is depicted in the figures as generally conical shaped like wall 102, and is shown generally centrally located in the open portion of the flow passage with respect to the wall 102, with a gap 144 between the main jet 130 and the wall 102. The main jet 130 need not, however, be conical shaped and other arrangements can be implemented instead. In addition, the main jet 130 need not be centrally located with respect to the wall 102 and may be offset instead. For the conical shaped main jet depicted in these figures, the major diameter portion 184 is seen to be adjacent to the cold surface side 54(*a*) of the liner, while the minor diameter portion 186 is seen to be adjacent to the hot surface side 54(*b*) of the liner.

The main jet 130 is seen to have a main jet flow passage 132 therethrough. The main jet flow passage 132 provides for a flow of oxidizer through the main jet from the cold surface side to the hot surface side of the liner. The main jet is seen to be formed of a conical shaped jet wall 134 having an inner surface 136 that defines the main jet flow passage 132 and an outer surface 138. The inner surface 136 may be relatively smooth so as to provide a relatively non-turbulent flow of the oxidizer through the main jet flow passage 132 into the combustion chamber 62. Alternatively, the inner surface 136 may also include turbulators 143. The outer surface 138 may also be smooth, or as seen in the figures, may include turbulators 142 attached thereto and extending into the gap 144 between the outer surface 138 and the wall 102. The turbulators 142 may be the same type as the turbulators 104 on the wall 102, or they may be of a different type.

The main jet 130 is seen to be supported by ribs 140. In FIGS. 6 to 8, the main jet 130 is shown supported by four ribs 140, but more than four ribs or less than four ribs could be implemented to support the main jet 130. In addition, FIGS. 6 to 8 depict ribs 140 located on the cold surface side 54(*a*) of the main jet 130 and do not depict ribs 140 located on the hot surface side of the main jet 130. It can be appreciated, however, that ribs 140 may also be disposed on the hot surface side of the main jet, or may be disposed anywhere in between the cold surface side and the hot surface side connecting the outer surface 138 to wall 102. In addition, while not shown in the figures, the ribs 140 may also include turbulators 104 attached thereto.

The dilution vortex turbulence generator depicted in FIGS. 6 to 8 generally provides for a flow of oxidizer from the cold surface side 52(*a*) of the inner liner 52 to the hot surface side 52(*b*) of the inner liner 52, or from the cold surface side 54(*a*) to the hot surface side 54(*b*) of the outer liner 54 through both the main jet 130 and through the turbulence generating portion 139 surrounding the main jet 130. Thus, as shown in FIG. 7, a relatively smooth main jet flow 150 of oxidizer is provided by the main jet 130 to the combustion chamber 62, while a turbulent flow 152 of the oxidizer is provided to the combustion chamber via the turbulence generator portion. At the outlet of the vortex turbulence generator in the combustion chamber (i.e., at the hot surface side 54(*b*)), the main jet flow 150 and the turbulent flow 152 mix with one another. As will be described later, this arrangement provides for a reduction of the hot combustion gases on the downstream portion of the outlet on the liner, thereby reducing NOx emissions and providing better liner durability.

Figure 9:
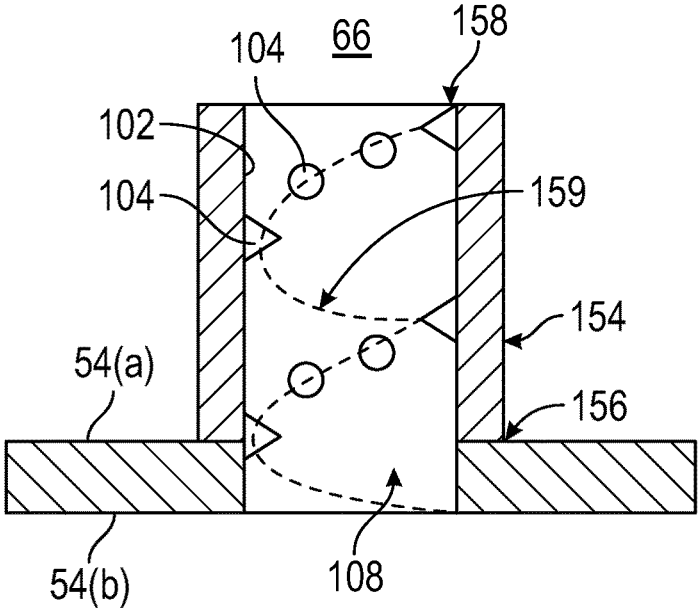
FIG. 9 is an example of an extension horn for a vortex turbulence generator, according to an embodiment of the present disclosure.

FIG. 9 depicts another embodiment of the vortex turbulence generator according to the present disclosure. In FIG. 9, an extension horn 154 is provided on the cold surface side 54(*a*) of the combustor liner. The extension horn 154 extends from the cold surface side 54(*a*) into the outer flow passage 66 (FIG. 2). The extension horn 154 includes a proximal end 156 at the cold surface side 54(*a*) and a distal end 158. Similar to FIGS. 3 and 4, a vortex turbulence generator is provided in the extension horn 154 and may extend from the distal end 158 through the flow passage 108 to the hot surface side 54(*b*). Thus, vortex generating turbulators 104 are provided about the inner flow passage 108 through the length of the extension horn 154. The vortex generating turbulators 104 may be arranged about the circumference in a helical pattern along the length of the flow passage 108 so that a vortex flow (generally depicted as 159) is generated exiting the flow passage 108 into the combustion chamber 62.

Figure 10:
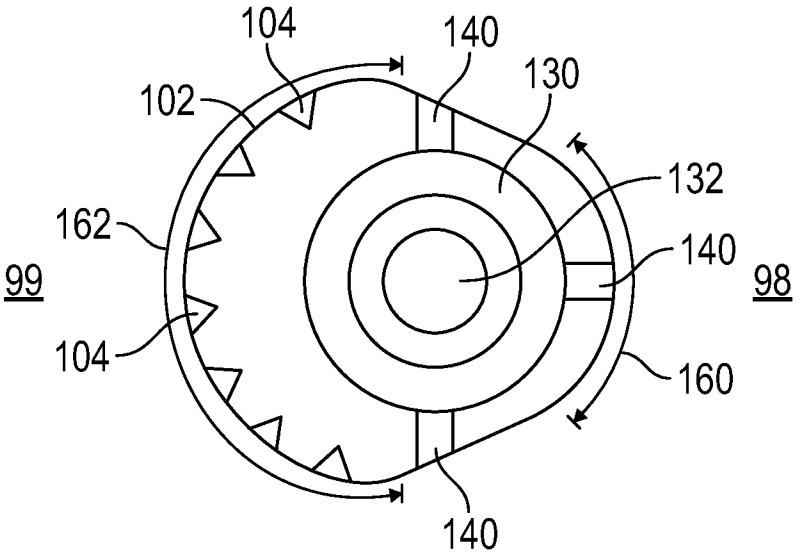
FIG. 10 is an example of an offset vortex turbulence generator, according to the present disclosure.

In another embodiment according to the present disclosure depicted in FIG. 10, a turbulence generator/main jet configuration similar to that shown in FIGS. 6 to 8 may be implemented in an non-concentric manner. FIG. 10 generally depicts an example plan view, where the turbulence generating portion is not circular like that shown in FIGS. 6 to 8, but may generally have a teardrop shape. That is, a first portion 160 of the wall 102 forming the flow passage 108 may be generally concentric with the main jet 130. A second portion 162 forming the wall 102 may be non-concentric with the main jet 130 and may be a larger size (e.g., diameter) than the first portion 160. In this arrangement, the first portion 160 and the main jet 130 are located toward an upstream end 98 of the vortex generator, while the second portion 162 may be located toward the downstream end 99 of the vortex generator. The wall 102 forming the second portion 162 is seen to include turbulators 104, while the first portion 160 may not include the turbulators 104. Thus, the second portion 162 of the turbulence generator may generate a turbulent flow of the oxidizer at a downstream side of the exit into the combustion chamber, while the main jet 130 provides a smooth (non-turbulent) flow of the oxidizer upstream of the turbulent flow. This arrangement can help to provide better turbulence at the downstream end of the flow so as to lower the temperature at the downstream side of the vortex generator.

In a comparison of the present disclosure with the conventional dilution hole, in the conventional dilution hole, combustion gases flow downstream and dilution air passes through the dilution hole to combustion chamber. A higher temperature of the gas is present at a mixing location behind the hole where the dilution air mixes with the combustion gases exiting the dilution hole. The higher temperature in the conventional dilution hole is due to a lack of turbulent mixing of the combustion gases and the dilution air. In addition, the conventional dilution hole has a small wake region at the downstream edge of the dilution hole. The small wake results in a higher concentration of the hot gases at the downstream edge. As a result, a higher temperature at the gas wall is concentrated at the downstream edge of the dilution hole, thereby reducing the life of the liner.

In contrast, for the vortex turbulence generator of the present disclosure, the gas temperature at the mixing location behind the hole is lower due to the turbulent air mixing with the hot combustion gases, thereby reducing NOx emissions. In addition, dilution air is present in the wake of the dilution stream, which reduces the temperature at the edge of the dilution hole on the downstream side, and spreads the hot gases further downstream. The lower temperature and spread of the dilution air provides better reliability of the liner.

As a further comparison between the conventional dilution hole and the vortex turbulence generator of the present disclosure, the vortex turbulence generator of the present disclosure provides for a lower velocity flow at the downstream side of the dilution air than the higher velocity flow in the conventional dilution hole. The lower velocity is indicative of the turbulent flow from the vortex turbulence generator entering the combustion chamber.

As yet a further comparison of turbulence kinetic energy (TKE) in the combustion chamber, in the conventional dilution hole, the turbulence is generally concentrated near the dilution hole, owing to the jet flow exiting the hole. In contrast, in the vortex turbulence generator of the present disclosure, the turbulent flow is spread out further downstream, thereby resulting in better mixing with the combustion gases and lowering NOx emissions.

The present disclosure further provides a method of providing a dilution flow of an oxidizer in a combustor of a gas turbine engine. According to the present disclosure, a flow of an oxidizer is provided at a cold surface side of a combustor liner. A flow of the oxidizer from the cold surface side of the combustor liner is provided to a vortex turbulence generator within the combustor liner. The vortex turbulence generator generates a vortex turbulent flow of the oxidizer, outputs the generated vortex turbulent flow to a combustion chamber on a hot surface side of the combustor liner. The generating of the turbulent flow in the vortex turbulence generator involves passing the flow of oxidizer over a vortex generating surface of a vortex turbulator, the vortex turbulator being disposed on a flow passage wall, the flow passage wall extending through the vortex turbulence generator and defining an oxidizer flow passage therethrough. The vortex turbulator extends from the flow passage wall into an open portion of the flow passage, and the vortex generating surface of the vortex turbulator generates a vortex flow of the oxidizer passing over the surface of the vortex turbulator within the vortex turbulence generator. The vortex turbulence generator may have a plurality of vortex turbulators disposed on the flow passage wall, and the plurality of vortex turbulators further generate a vortex flow of the oxidizer about the flow passage within the vortex turbulence generator. Still further, the vortex turbulence generator is arranged to provide a non-turbulent oxidizer flow jet through a central portion of the vortex turbulence generator from the cold surface side of the combustor liner to the hot surface side of the combustor liner, and the non-turbulent oxidizer flow jet is output together with the vortex turbulent flow of the oxidizer into the combustion chamber, the vortex turbulent flow being output surrounding the non-turbulent oxidizer flow jet.

While the foregoing description relates generally to a gas turbine engine, it can readily be understood that the gas turbine engine may be implemented in various environments. For example, the engine may be implemented in an aircraft, but may also be implemented in non-aircraft applications such as power generating stations, marine applications, or oil and gas production applications. Thus, the present disclosure is not limited to use in aircraft.

Further aspects of the present disclosure are provided by the subject matter of the following clauses.

A combustor for a gas turbine, comprising, a combustor liner having a cold surface side and a hot surface side, a combustion chamber arranged on the hot surface side of the combustor liner, a vortex turbulence generator arranged on the combustor liner, comprising, a turbulence generator flow passage extending through the combustor liner from the cold surface side of the combustor liner to the hot surface side of the combustor liner, the turbulence generator flow passage being defined by a turbulence generator wall about a periphery of the turbulence generator flow passage, and a plurality of vortex generating turbulators disposed on the turbulence generator wall, each of the plurality of vortex generating turbulators including a projection portion extending from a surface of the turbulence generator wall into the turbulence generator flow passage and generating a vortex turbulent flow of an oxidizer passing through the turbulence generator flow passage from the cold surface side of the combustor liner to the hot surface side of the combustor liner.

The combustor according to any preceding clause, wherein at least a portion of the turbulence generator wall is a conical surface, a major diameter of the conical surface being disposed toward the cold surface side of the combustor liner and a minor diameter of the conical surface being disposed toward the hot surface side of the combustor liner.

The combustor according to any preceding clause, wherein the plurality of vortex generating turbulators comprises a plurality of rows of vortex generating turbulators disposed on the turbulence generator wall, a first row among the plurality of rows of vortex generating turbulators being disposed adjacent to the cold surface side of the combustor liner and a second row of the plurality of rows of vortex generating turbulators being disposed adjacent to the hot surface side of the combustor liner.

The combustor according to any preceding clause, wherein vortex generating turbulators in the first row are rotationally staggered on the turbulence generator wall about a center axis of the turbulence generator flow passage with respect to vortex generating turbulators in the second row.

The combustor according to any preceding clause, wherein each of the vortex generating turbulators are a conical element, a base portion of the conical element being disposed on the turbulence generator wall, and an apex portion of the conical element extending into the turbulence generator flow passage.

The combustor according to any preceding clause wherein the vortex turbulence generator further comprises an extension horn having a proximal end at the cold surface side of the combustor liner and a distal end extending from the cold surface side of the combustor liner, wherein the turbulence generator flow passage further extends through the extension horn from the proximal end through the distal end.

The combustor according to any preceding clause, wherein the vortex turbulence generator further comprises a main jet, the main jet comprising a jet wall having a main jet flow passage therethrough, the jet wall having a jet wall inner surface that defines the main jet flow passage, and a jet wall outer surface, wherein the main jet extends from the cold surface side of the combustor liner to the hot surface side of the combustor liner, and wherein the main jet is disposed within the turbulence generator flow passage with a gap between the turbulence generator wall and the jet wall outer surface.

The combustor according to any preceding clause further comprising a plurality of vortex generating turbulators disposed on the jet wall outer surface and extending into the gap.

The combustor according to any preceding clause, wherein the turbulence generator wall, the jet wall inner surface, and the jet wall outer surface each comprise a conical surface in radial arrangement with one another, a major diameter portion of each conical surface being disposed at the cold surface side of the combustor liner and a minor diameter portion of each conical surface being disposed at the hot surface side of the combustor liner.

The combustor according to any preceding clause, wherein the main jet provides a non-turbulent flow of the oxidizer into the combustion chamber, and wherein the turbulence generator provides a turbulent vortex flow of the oxidizer into the combustion chamber, the turbulent vortex flow surrounding the non-turbulent flow at the hot surface side of the combustor liner.

The combustor according to any preceding clause, wherein the turbulence generator wall comprises a first portion that is concentric with the main jet, the first portion being on an upstream side of the vortex turbulence generator, and a second portion that is non-concentric with the main jet, the second portion being on a downstream side of the vortex turbulence generator and having a larger radius than the first portion.

The combustor according to any preceding clause, wherein the plurality of turbulators disposed on the wall of the turbulence generator are disposed on the second portion and are not disposed on the first portion.

The combustor according to any preceding clause further comprising a plurality of vortex generating turbulators disposed on the jet wall inner surface.

Further aspects of the present disclosure are provided by the subject matter of the following further clauses.

A dilution vortex turbulence generator for a combustor of a gas turbine, the generator comprising, a base body having a cold surface side and a hot surface side, a turbulence generator flow passage extending through the base body from the cold surface side to the hot surface side, the turbulence generator flow passage being defined by a turbulence generator wall about a periphery of the turbulence generator flow passage, and a plurality of vortex generating turbulators disposed on the turbulence generator wall, each of the plurality of vortex generating turbulators including a projection portion extending from a surface of the turbulence generator wall into the turbulence generator flow passage and generating a vortex turbulent flow of an oxidizer passing through the turbulence generator flow passage from the cold surface side of the base body to the hot surface side of the base body.

The dilution vortex turbulence generator according to any preceding clause, wherein at least a portion of the turbulence generator wall is a conical surface, a major diameter of the conical surface being disposed toward the cold surface side of the base body and a minor diameter of the conical surface being disposed toward the hot surface side of the base body.

The dilution vortex turbulence generator according to any preceding clause, wherein the plurality of vortex generating turbulators comprises a plurality of rows of the vortex generating turbulators disposed on the turbulence generator wall, a first row among the plurality of rows being disposed adjacent to the cold surface side of the base body and a second row of the plurality of rows being disposed adjacent to the hot surface side of the base body.

The dilution vortex turbulence generator according to any preceding clause, wherein the vortex generating turbulators in the first row are rotationally staggered on the turbulence generator wall about a center axis of the turbulence generator flow passage with respect to the vortex generating turbulators in the second row.

The dilution vortex turbulence generator according to any preceding clause, wherein each of the vortex generating turbulators are a conical element, a base portion of the conical element being disposed on the turbulence generator wall, and an apex portion of the conical element extending into the turbulence generator flow passage.

The dilution vortex turbulence generator according to any preceding clause further comprising an extension horn having a proximal end at the cold surface side of the base body and a distal end extending from the cold surface side of the base body, wherein the turbulence generator flow passage further extends through the extension horn from the proximal end through the distal end.

The dilution vortex turbulence generator according to any preceding clause further comprising a main jet, the main jet comprising a jet wall having a main jet flow passage therethrough, the jet wall having a jet wall inner surface that defines the main jet flow passage, and a jet wall outer surface, wherein the main jet extends from the cold surface side of the base body to the hot surface side of the base body, and wherein the main jet is disposed within the turbulence generator flow passage with a gap between the turbulence generator wall and the jet wall outer surface.

The dilution vortex turbulence generator according to any preceding clause further comprising a plurality of vortex generating turbulators disposed on the jet wall outer surface and extending into the gap.

The dilution vortex turbulence generator according to any preceding clause further comprising a plurality of vortex generating turbulators disposed on the jet wall inner surface.

The dilution vortex turbulence generator according to any preceding clause, wherein the turbulence generator wall, the jet wall inner surface, and the jet wall outer surface each comprise a conical surface in radial arrangement with one another, a major diameter portion of each conical surface being disposed at the cold surface side of the base body and a minor diameter portion of each conical surface being disposed at the hot surface side of the base body.

The dilution vortex turbulence generator according to any preceding clause, wherein the surface of the turbulence generator wall comprises a first portion that is concentric with the main jet, the first portion being on an upstream side of the dilution vortex turbulence generator, and a second portion that is non-concentric with the main jet, the second portion being on a downstream side of the dilution vortex turbulence generator and having a larger radius than the first portion.

The dilution vortex turbulence generator according to any preceding clause, wherein the plurality of turbulators disposed on the turbulence generator wall are disposed on the second portion and are not disposed on the first portion.

Further aspects of the present disclosure are provided by the subject matter of the following clauses.

A method of providing a dilution flow of an oxidizer in a combustor of a gas turbine, the method comprising, providing a flow of an oxidizer at a cold surface side of a combustor liner, providing a flow of the oxidizer from the cold surface side of the combustor liner to a vortex turbulence generator within the combustor liner, generating, within the vortex turbulence generator, a vortex turbulent flow of the oxidizer, and outputting, from the vortex turbulence generator to a combustion chamber on the hot surface side of the combustor liner, the vortex turbulent flow of the oxidizer generated in the generating step, wherein the generating step comprises: passing the flow of oxidizer over a vortex generating surface of a vortex turbulator, the vortex turbulator being disposed on a flow passage wall, the flow passage wall extending through the vortex turbulence generator and defining an oxidizer flow passage therethrough, wherein the vortex turbulator extends from the flow passage wall into an open portion of the flow passage, and wherein the vortex generating surface of the vortex turbulator generates a vortex flow of the oxidizer passing over the surface of the vortex turbulator within the vortex turbulence generator.

The method according to any preceding clause, wherein the vortex turbulence generator comprises a plurality of vortex turbulators disposed on the flow passage wall, wherein the plurality of vortex turbulators further generate a vortex flow of the oxidizer about the flow passage within the vortex turbulence generator.

The method according to any preceding clause, wherein the vortex turbulence generator is arranged to provide a non-turbulent oxidizer flow jet through a central portion of the vortex turbulence generator from the cold surface side of the combustor liner to the hot surface side of the combustor liner, and wherein, in the outputting, the non-turbulent oxidizer flow jet is output together with the vortex turbulent flow of the oxidizer into the combustion chamber, the vortex turbulent flow being output surrounding the non-turbulent oxidizer flow jet.

Although the foregoing description is directed to some exemplary embodiments of the present disclosure, it is noted that other variations and modifications will be apparent to those skilled in the art, and may be made without departing from the spirit or scope of the disclosure. Moreover, features described in connection with one embodiment of the present disclosure may be used in conjunction with other embodiments, even if not explicitly stated above.

What is claimed is:

1. A combustor for a gas turbine, the combustor comprising:

a combustor liner having a cold surface side and a hot surface side;

a combustion chamber arranged on the hot surface side of the combustor liner;

a vortex turbulence generator arranged on the combustor liner, the vortex turbulence generator comprising:

a turbulence generator flow passage extending through the combustor liner from the cold surface side of the combustor liner to the hot surface side of the combustor liner, the turbulence generator flow passage being defined by a turbulence generator wall about a periphery of the turbulence generator flow passage, the turbulence generator wall extending between the cold surface side and the hot surface side; and a plurality of vortex generating turbulators disposed on the turbulence generator wall, each of the plurality of vortex generating turbulators including a projection portion extending from a surface of the turbulence generator wall into the turbulence generator flow passage and generating a vortex turbulent flow of an oxidizer passing through the turbulence generator flow passage from the cold surface side of the combustor liner to the hot surface side of the combustor liner, wherein the vortex turbulence generator further comprises a main jet, the main jet comprising a jet wall having a main jet flow passage therethrough, the jet wall having a jet wall inner surface that defines the main jet flow passage, and a jet wall outer surface, wherein the main jet extends from the cold surface side of the combustor liner to the hot surface side of the combustor liner, wherein the main jet is disposed within the turbulence generator flow passage with a gap between the turbulence generator wall and the jet wall outer surface, wherein the vortex turbulence generator further comprises a plurality of ribs extending from the turbulence generator wall to the jet wall and radially from at least one of the cold surface side of the combustor liner or the hot surface side of the combustor liner to support the jet wall, each of the plurality of ribs having a side coplanar with at least one of the cold surface side of the combustor liner or the hot surface side of the combustor liner, and wherein at least one of the plurality of vortex generating turbulators is pyramidal shaped and includes a primary flow interface surface having a plurality of triangular shaped surfaces, a base of each of the plurality of triangular shaped surfaces extending across an upstream side of the respective triangular shaped surface with regard to a flow direction of the oxidizer passing through the turbulence generator flow passage, and an apex of each of the plurality of triangular shaped surfaces being downstream of the base with regard to the flow direction.

2. The combustor according to claim 1, wherein at least a portion of the turbulence generator wall is a conical surface, a major diameter of the conical surface being disposed toward the cold surface side of the combustor liner and a minor diameter of the conical surface being disposed toward the hot surface side of the combustor liner.

3. The combustor according to claim 1, wherein the plurality of vortex generating turbulators comprises a plurality of rows of vortex generating turbulators disposed on the turbulence generator wall, a first row among the plurality of rows of vortex generating turbulators being disposed adjacent to the cold surface side of the combustor liner and a second row of the plurality of rows of vortex generating turbulators being disposed adjacent to the hot surface side of the combustor liner.

4. The combustor according to claim 3, wherein vortex generating turbulators in the first row are rotationally staggered on the turbulence generator wall about a center axis of the turbulence generator flow passage with respect to vortex generating turbulators in the second row.

5. The combustor according to claim 1, further comprising a plurality of vortex generating turbulators disposed on the jet wall outer surface and extending into the gap.

6. The combustor according to claim 1, wherein the turbulence generator wall, the jet wall inner surface, and the jet wall outer surface each comprise a conical surface in radial arrangement with one another, a major diameter portion of each conical surface being disposed at the cold surface side of the combustor liner and a minor diameter portion of each conical surface being disposed at the hot surface side of the combustor liner.

7. The combustor according to claim 1, wherein the main jet provides a non-turbulent flow of the oxidizer into the combustion chamber, and wherein the vortex turbulence generator provides the vortex turbulent flow of the oxidizer into the combustion chamber, the vortex turbulent flow surrounding the non-turbulent flow at the hot surface side of the combustor liner.

8. The combustor according to claim 1, wherein the turbulence generator wall comprises a first portion that is concentric with the main jet, the first portion being on an upstream side of the vortex turbulence generator, and a second portion that is non-concentric with the main jet, the second portion being on a downstream side of the vortex turbulence generator and having a larger radius than the first portion.

9. The combustor according to claim 8, wherein the plurality of vortex generating turbulators disposed on the turbulence generator wall are disposed on the second portion and are not disposed on the first portion.

10. The combustor according to claim 1, further comprising a plurality of vortex generating turbulators disposed on the jet wall inner surface.

11. A dilution vortex turbulence generator for a combustor of a gas turbine, the dilution vortex turbulence generator comprising:

a base body having a cold surface side and a hot surface side;

a turbulence generator flow passage extending through the base body from the cold surface side to the hot surface side, the turbulence generator flow passage being defined by a turbulence generator wall about a periphery of the turbulence generator flow passage, the turbulence generator wall extends between the cold surface side and the hot surface side; and a plurality of vortex generating turbulators disposed on the turbulence generator wall, each of the plurality of vortex generating turbulators including a projection portion extending from a surface of the turbulence generator wall into the turbulence generator flow passage and generating a vortex turbulent flow of an oxidizer passing through the turbulence generator flow passage from the cold surface side of the base body to the hot surface side of the base body, and further comprising a main jet, the main jet comprising a jet wall having a main jet flow passage therethrough, the jet wall having a jet wall inner surface that defines the main jet flow passage, and a jet wall outer surface, wherein the main jet extends from the cold surface side of the base body to the hot surface side of the base body, wherein the main jet is disposed within the turbulence generator flow passage with a gap between the turbulence generator wall and the jet wall outer surface, wherein the dilution vortex turbulence generator further comprises a plurality of ribs extending from the turbulence generator wall to the jet wall and radially from at least one of the cold surface side of the base body or the hot surface side of the base body to support the jet wall, each of the plurality of ribs having a side coplanar with at least one of the cold surface side of the base body or the hot surface side of the base body, and wherein at least one of the plurality of vortex generating turbulators is pyramidal shaped and includes a primary flow interface surface having a plurality of triangular shaped surfaces, a base of each of the plurality of triangular shaped surfaces extending across an upstream side of the respective triangular shaped surface with regard to a flow direction of the oxidizer passing through the turbulence generator flow passage, and an apex of each of the plurality of triangular shaped surfaces being downstream of the base with regard to the flow direction.

12. The dilution vortex turbulence generator according to claim 11, wherein at least a portion of the turbulence generator wall is a conical surface, a major diameter of the conical surface being disposed toward the cold surface side of the base body and a minor diameter of the conical surface being disposed toward the hot surface side of the base body.

13. The dilution vortex turbulence generator according to claim 11, wherein the plurality of vortex generating turbulators comprises a plurality of rows of vortex generating turbulators disposed on the turbulence generator wall, a first row among the plurality of rows of vortex generating turbulators being disposed adjacent to the cold surface side of the base body and a second row of the plurality of rows of vortex generating turbulators being disposed adjacent to the hot surface side of the base body.

14. The dilution vortex turbulence generator according to claim 13, wherein vortex generating turbulators in the first row are rotationally staggered on the turbulence generator wall about a center axis of the turbulence generator flow passage with respect to vortex generating turbulators in the second row.

15. The dilution vortex turbulence generator according to claim 11, further comprising a plurality of vortex generating turbulators disposed on the jet wall outer surface and extending into the gap.

* * * * *